US006454680B1

(12) United States Patent
Taimela

(10) Patent No.: US 6,454,680 B1
(45) Date of Patent: Sep. 24, 2002

(54) APPARATUS FOR EXERCISE AND/OR REHABILITATION OF NECK EXTENSORS

(75) Inventor: Simo Taimela, Vantaa (FI)

(73) Assignee: DBC International Oy, Vantaa (FI)

( * ) Notice: Subject to any disclaimer, the term of this patent is extended or adjusted under 35 U.S.C. 154(b) by 0 days.

(21) Appl. No.: 09/582,718

(22) PCT Filed: Dec. 28, 1998

(86) PCT No.: PCT/FI98/01024

§ 371 (c)(1),
(2), (4) Date: Jun. 30, 2000

(87) PCT Pub. No.: WO99/34877

PCT Pub. Date: Jul. 15, 1999

(51) Int. Cl.[7] ..... A63B 23/025

(52) U.S. Cl. ..... 482/10; 482/13; 482/907; 482/137

(58) Field of Search ..... 482/130, 142, 482/140, 10, 100, 137, 148, 908, 907

(56) References Cited

U.S. PATENT DOCUMENTS

| | | | |
|---|---|---|---|
| 4,893,808 | A | 1/1990 | McIntyre et al. |
| 5,112,286 | A | 5/1992 | Jones |
| 5,360,383 | A | 11/1994 | Boren |

*Primary Examiner*—Jerome W. Donnelly
(74) *Attorney, Agent, or Firm*—Young & Thompson

(57) ABSTRACT

The apparatus includes a link rod (5) pivoted by its first end (6) on the equipment frame via a first joint (7) permitting a turning motion about a swing axis (8) perpendicular to the vertical middle plane of the seat. A head rest (9) is functionally connected to the link rod (5) so that the link rod participates in turning the head rest during an exercise movement while the person's head is leaning against the head rest. The apparatus also includes a multi-joint angular linkage mechanism (12), of which the link rod (5) constitutes a part. The multi-joint angular linkage mechanism (12) is connected to the head rest (9) so as to cause it to move during an exercise movement along a curved path that substantially coincides with the natural path of the neck.

15 Claims, 6 Drawing Sheets

APPARATUS FOR EXERCISE AND/OR REHABILITATION OF NECK EXTENSORS

BACKGROUND OF THE INVENTION

The present invention relates to an apparatus for exercising or rehabilitating neck extensors.

Most of the movements of the joints and especially limbs of the human body are based on a structure in which a tubular bone is joined to another tubular bone via a so-called hinge joint. The movement resembles the action of a mechanical hinge and takes place mainly two-dimensionally about a pivot point with a constant radius. An example of such movement is that of the elbow joint. However, the action of a hinge joint is not quite as simple as this, but this is the basic principle.

The action of the spine is not as simple as this. The spinal column consists of vertebrae and disks between them. Adjacent vertebrae are joined together via the disk and so-called facet joints. Successive vertebrae and the disk between them are called a functional spine unit (FSU). The movements of the spine cannot be described on the principle of the hinge joint, but the FSU always works in a three-dimensional fashion, comprising both rotation and sliding in different directions of motion.

Due to the structure of a pair of vertebrae, in which the facet joints and spinal processes limit the movement in the extension direction, the spine does not work like a hinge joint in the extension-flexion direction. The extension of the spine takes place as a series of "opening movements" of individual FSU structures as each inter-vertebral space is increased while the facets lean on each other. Correspondingly, the inter-vertebral space becomes narrower as the spine is flexed. This narrowing takes place as a series of flexion movements occurring progressively in motional segments from the top downwards. In movements in the flexion-extension direction, some sliding also takes place at the same time (Dvorak J & Dvorak V: Manual Medicine: Diagnostics. Georg Thieme Verlag, Stuttgart, 1990; Nordin M & Frankel V H (ed.): Basic Biomechanics of the Musculosceletal System: Lea Febiger, Philadelphia 1980; White A M & Panjabi M: The basic kinematics of the human spine 1978; 3:13 and White A M & Panjabi M: Clinical Biomechanics of the Spine. Lippincott, Philadelphia, 1978).

In consequence of this mechanism, the flexion movement of the spine does not follow a radial arc about a single centre, but the movement takes place on the principle of a changing centre of motion. For instance, by observing the path of the head, this results in a path resembling an elliptical rather than a circular arc. The radius of the ellipse is largest when the spine is fully extended and smallest when the spine is fully flexed.

In prior art, an apparatus for exercise and/or rehabilitation of neck extensors with flexion and extension movements between an extreme flexion position and an extreme extension position is known. The apparatus comprises an equipment frame, a seat provided with a back rest, and holding means for holding a person's body substantially immobile in position in relation to the back rest. Furthermore, the apparatus comprises a link rod pivoted by its first end on the equipment frame via a first joint permitting a turning motion about a swing axis perpendicular to the vertical middle plane of the seat. In addition, the apparatus comprises a head rest functionally connected to the link rod so that the link rod participates in turning the head rest during an exercise movement while the person's head is leaning against the head rest, and a resistance means for providing resistance to the exercise movement. An apparatus of this type is known e.g. from specification U.S. Pat. No. 5,336,138, wherein the head is held in a supporting frame acting as a head rest that holds the person's head via contact with the back and sides of the head. The supporting frame is joined to the link rod. The lower end of the link rod is mounted with a ball joint on the back rest of the seat.

A problem with the prior-art apparatus is that the path of the part holding the head does not coincide with the natural path of motion of the head during flexion and extension of the neck because in the prior-art apparatus the turning motion takes place about a single centre, which means that the path is a circular arc. However, as stated above, the natural path of the head is not a circular arc but a path of a different type. In flexion and extension exercises with prior-art apparatus, an incorrect motional pattern is learned and the incorrectly applied load may result in a risk of injury. Besides, the chafing of the head against the head rest is annoying.

SUMMARY OF THE INVENTION

The object of the present invention is to eliminate the drawbacks described above. A specific object of the present invention is to disclose an apparatus in which a head rest path deviating from a circular path is achieved so that the head rest moves along a path corresponding to the natural path of motion of the cervical spine.

The apparatus of the invention comprises an equipment frame, a seat provided with a back rest, and holding means for holding a person's body substantially immobile in position relative to the back rest; a link rod pivoted by its first end on the equipment frame via a first joint permitting a turning motion about a swing axis perpendicular to the vertical middle plane of the seat; a head rest functionally connected to the link rod so that the link rod participates in turning the head rest during an exercise movement while the person's head is leaning against the head rest, and a resistance means for producing a force opposing the exercise movement.

According to the invention, the apparatus comprises adjusting elements for adjustment of the position of the seat in relation to the equipment frame. The head rest is substantially fitted to receive the upper part of the person's neck, preferably the area of the topmost two cervical vertebrae. The apparatus comprises a multi-joint angular linkage mechanism, of which the link rod constitutes a part, said multi-joint angular linkage mechanism being connected to the head rest so as to cause it to move during an exercise movement along a curved path that substantially coincides with the natural path of the neck during flexion and extension movements of the neck without producing any relative motion between the head rest and the point of contact between the neck and the head rest.

Using the adjusting elements of the seat, a person can be individually positioned in a precisely defined position relative to the equipment frame and the mechanism turning the head rest. By fitting the head rest so that it meets the upper part of the neck, preferably the area of soft tissue of the neck, which lies in the upper region of the cervical spine in the area of the topmost cervical vertebrae c1 and c2, an exercise movement is achieved that does not stress the muscles connecting the cranial base to the upper part of the cervical spine, thus ensuring that no sliding occurs between the topmost cervical vertebrae as in prior-art apparatus. The multi-joint angular linkage mechanism allows head rest motion along a path corresponding to the natural path of neck motion so that the head rest does not move in relation to the neck during exercise and no mutual chaffing occurs but the head rest follows the same path with the neck. The magnitude and application of stress following natural paths can be adjusted during physical exercise. The advantages of stress following natural paths include the following. During exercise, the stress is applied in the correct manner to the tissues to which it is intended to be applied. Furthermore, correct motional patterns are learned. This means that the motional patterns learned during exercise are likely to be correctly observed even outside the exercise or rehabilitation situation. In addition, the risk of injury due to incorrect stress during exercise and rehabilitation is reduced.

In an embodiment of the apparatus, the path of the head rest is a path with a varying radius, such as an elliptical path. As the flexion-extension movement of the spine does not take place along a radial arc about a single centre but occurs on the principle of changing centre of motion, the head rest preferably follows a path resembling an elliptical curvature. The radius of the ellipse is at a maximum when the spine is completely extended and at a minimum when the neck is completely flexed.

In an embodiment of the apparatus, the multi-joint angular linkage mechanism is functionally a so-called five-joint planar mechanism. The apparatus comprises a control gear for controlling the motion of the multi-joint angular linkage mechanism. The control gear is rotatable about a swing axis immovable with respect to the equipment frame. The swing axis is disposed at a distance from the first joint but in its vicinity. It is obvious that suitable paths can also be achieved using other types of planar multi-joint angular linkage mechanisms.

In an embodiment of the apparatus, the apparatus comprises an auxiliary link rod whose first end is pivoted on the equipment frame via a second joint disposed at a distance from the first joint but in its vicinity. The apparatus further comprises a head rest support to which the head rest is attached, the second end of the auxiliary link rod being pivoted on the head rest support via a third joint. The control gear comprises a first frame component, which is rotatably mounted on the equipment frame and provided with a first guide disposed at a distance from the centre of rotation of the first frame component, and a second frame component, which is provided with a second guide, forming a guide pair with the first guide, permitting movement of the second frame component in a direction determined by the guides in relation to the first frame component. The head rest support is pivoted on the second frame component via a fourth joint, which is at a distance from the third joint. The second end of the link rod is pivoted on the second frame component via a fifth joint, which is at a distance from the third joint and the fourth joint. Thus, the five-joint planar mechanism consists of the rigid parts of the mechanism and equipment frame between the first, second, third, fourth and fifth joints.

In an embodiment of the apparatus, the link rod comprises second adjusting elements to allow adjustment of the distance between the first joint and the fifth joint, i.e. of the length of the link rod between the joints. Further, the auxiliary link rod may comprise third adjusting elements to allow adjustment of the distance between the second joint and the third joint, i.e. of the length of the link rod between these joints. By adjusting the lengths of these link rods of the multi-joint angular linkage mechanism, the path of the head rest can be adjusted individually for each person.

In an embodiment of the apparatus, the apparatus comprises a resistance means to provide resistance to the turning motion of the link rod and/or auxiliary link rod.

In an embodiment of the apparatus, the apparatus comprises a turning arbor rotatably mounted with bearings on the equipment frame. The first frame component is attached to the turning arbor. The resistance means is connected to the turning arbor to generate a torque opposing the rotation of the turning arbor.

In an embodiment of the apparatus, the resistance means works on a gravity resistance principle. The resistance means comprises a counterweight consisting of a number of individual weight elements of a given weight, which can be combined so as to create a predetermined load.

The resistance means comprises an eccentric gear connected to the turning arbor and comprising an eccentric surface or the like. A flexible elongated draw element is connected to the counterweight and, on the other hand, arranged in functional contact with the eccentric surface or the like. As the draw element is wound around the eccentric surface or the like, a load opposing the exercise movement with a force that varies in a predetermined manner as a function of the rotational angle of the turning arbor.

In an embodiment of the apparatus, the first frame component comprises a balancing counterweight for balancing the structural assembly rotating about the swing axis. Thus, the apparatus permits a so-called zero stress situation to be achieved, which means that it does not generate any resistance to the turning movement of the head rest.

In an embodiment of the apparatus, the first frame component comprises fourth adjusting elements for the adjustment of the distance of the balancing counterweight from the swing axis.

BRIEF DESCRIPTION OF THE DRAWINGS

In the following, the invention will be described in detail by the aid of a few examples of its embodiments by referring to the attached drawings, wherein.

DESCRIPTION OF THE PREFERRED EMBODIMENTS

Figure 1:
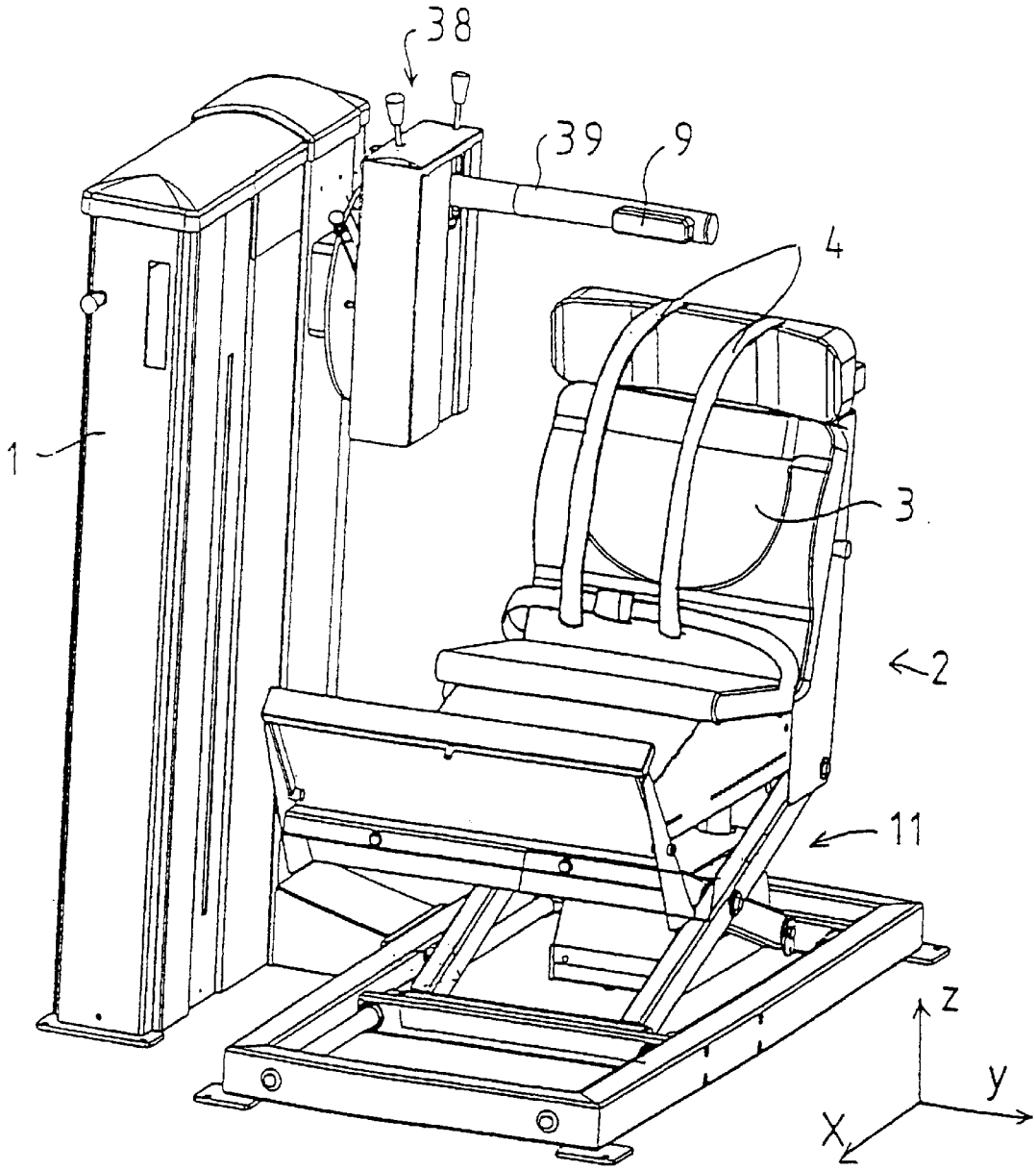
FIG. 1 presents a first embodiment of the apparatus of the invention in an oblique axonometric front view.
Figure 2:
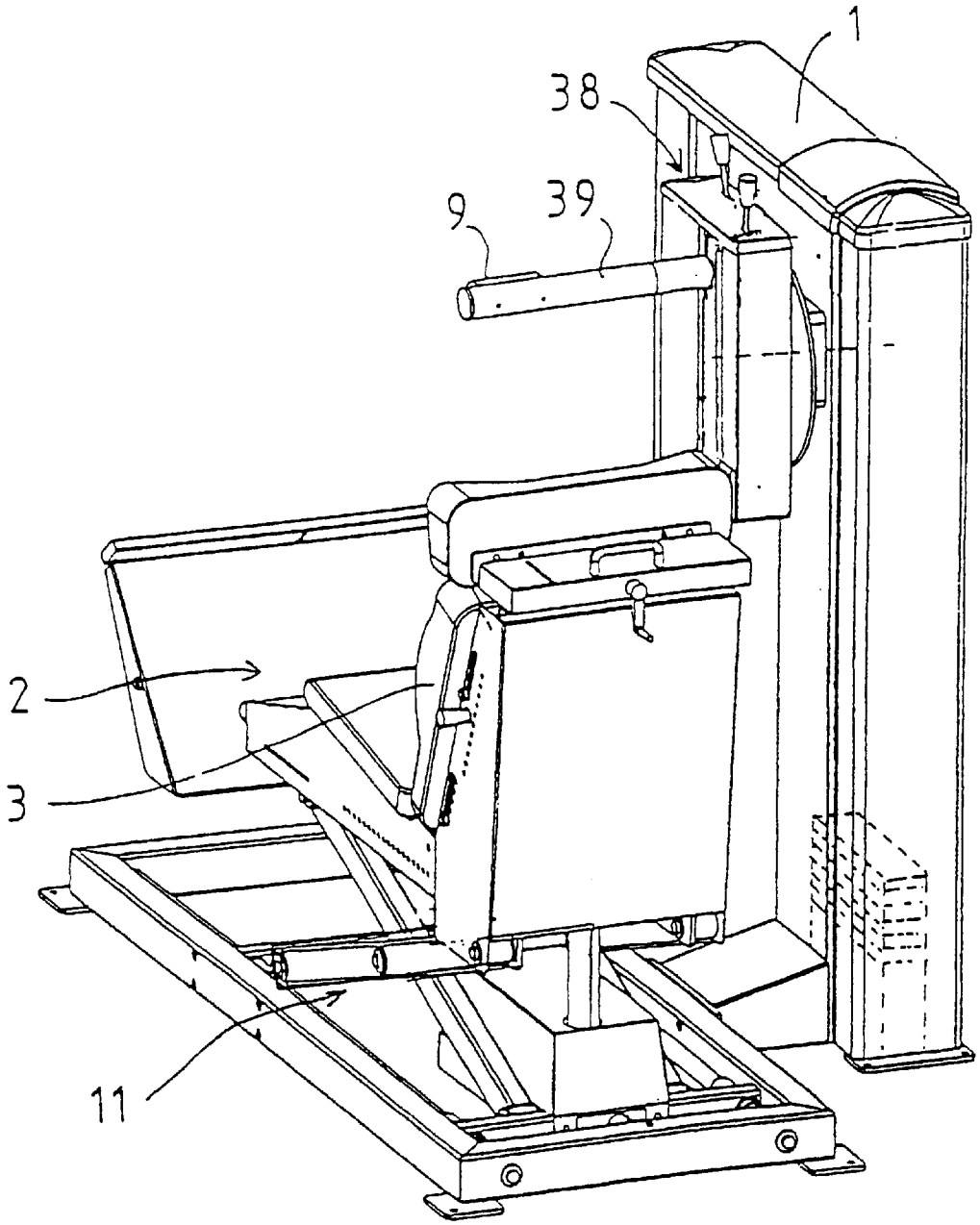
FIG. 2 presents the apparatus of FIG. 1 in an oblique rear view.
Figure 6:
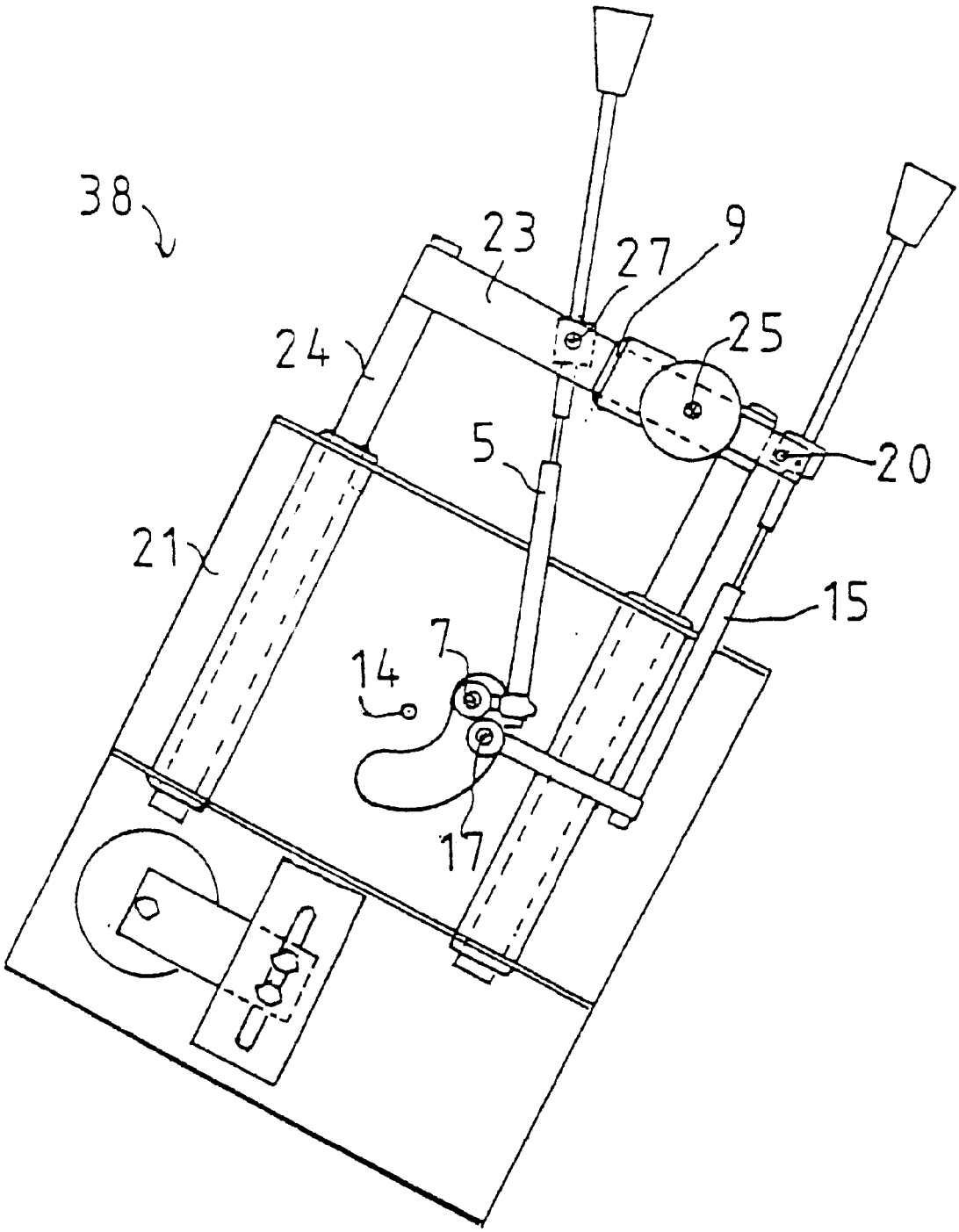
FIG. 6 presents the mechanism of FIG. 3, turned to a position corresponding to the extreme extended position of the neck.
Figure 7:
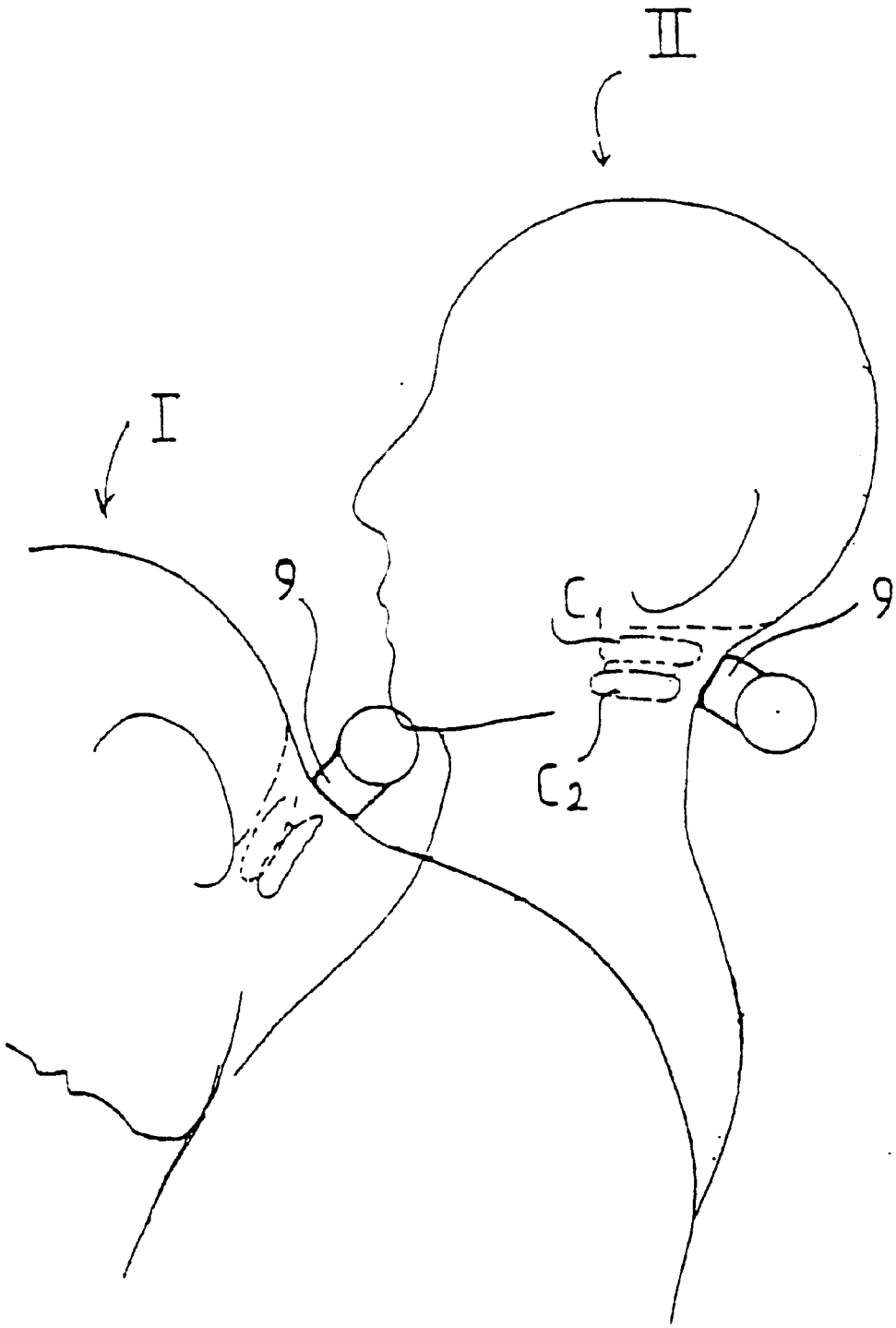
FIG. 7 is a diagrammatic side view showing the positions of the head and the head rest corresponding to the positions of the apparatus shown in FIGS. 3 and 6.

FIGS. 1 and 2 present an apparatus that can be used to exercise and rehabilitate neck extensors by a flexion and extension movement of the neck, an example of the two extreme positions of such a movement being shown in FIG. 7. In flexion (position I), the head is bent forward so that the jaw is pressed against the chest and the face is turned downward. In extension (position II), the head is somewhat tilted back and the face is turned upward. The initial position of the exercise movement to be performed with the apparatus is the flexion position. The head rest pad 9 is placed against the neck, and the turning motion of the head rest towards the extension position is opposed by a resistance device 10 (to be described with reference to FIGS. 5 and 6) with a suitable load so as to exercise the neck extensors. Using a mechanism as described below, the head rest pad 9, placed so that it leans on the person's neck in the area of the topmost two cervical vertebrae c1 and c2, remains in the same position in relation to the neck throughout the exercise movement, following the natural path of the neck all the time.

The apparatus presented in FIGS. 1 and 2 comprises a vertical equipment frame 1 in which the resistance mechanism for neck exercise is disposed. Placed beside the equipment frame 1 is a seat 2. The seat 2 comprises a seat part, a foot rest and a back rest 3. The seat is provided with a four-point belt 4 serving to tie the torso of the person doing neck exercise to the back rest 3 of the seat. To enable the person tied to the seat to be brought exactly to the correct position relative to the equipment frame 1 and the head rest pad 9 attached to it and its turning mechanism, the seat 2 is provided with versatile adjusting elements 11. Depicted in the figure is a coordinate system in which the x direction corresponds to the sitting direction, the y direction corresponds to a horizontal direction perpendicular to the x direction, and the z direction corresponds to the vertical direction. Using the adjusting elements 11, the seat 2 can be adjusted in the x and z directions. Practical implementation of the seat adjustments is part of the expertise of the skilled person, so it will not be described here in detail.

Extending in the y direction perpendicular to the sitting direction (x) from the turning mechanism 38 attached to the equipment frame 1 beside the seat 2 is a bar 39 to which the head rest pad 9 is attached.

Figure 3:
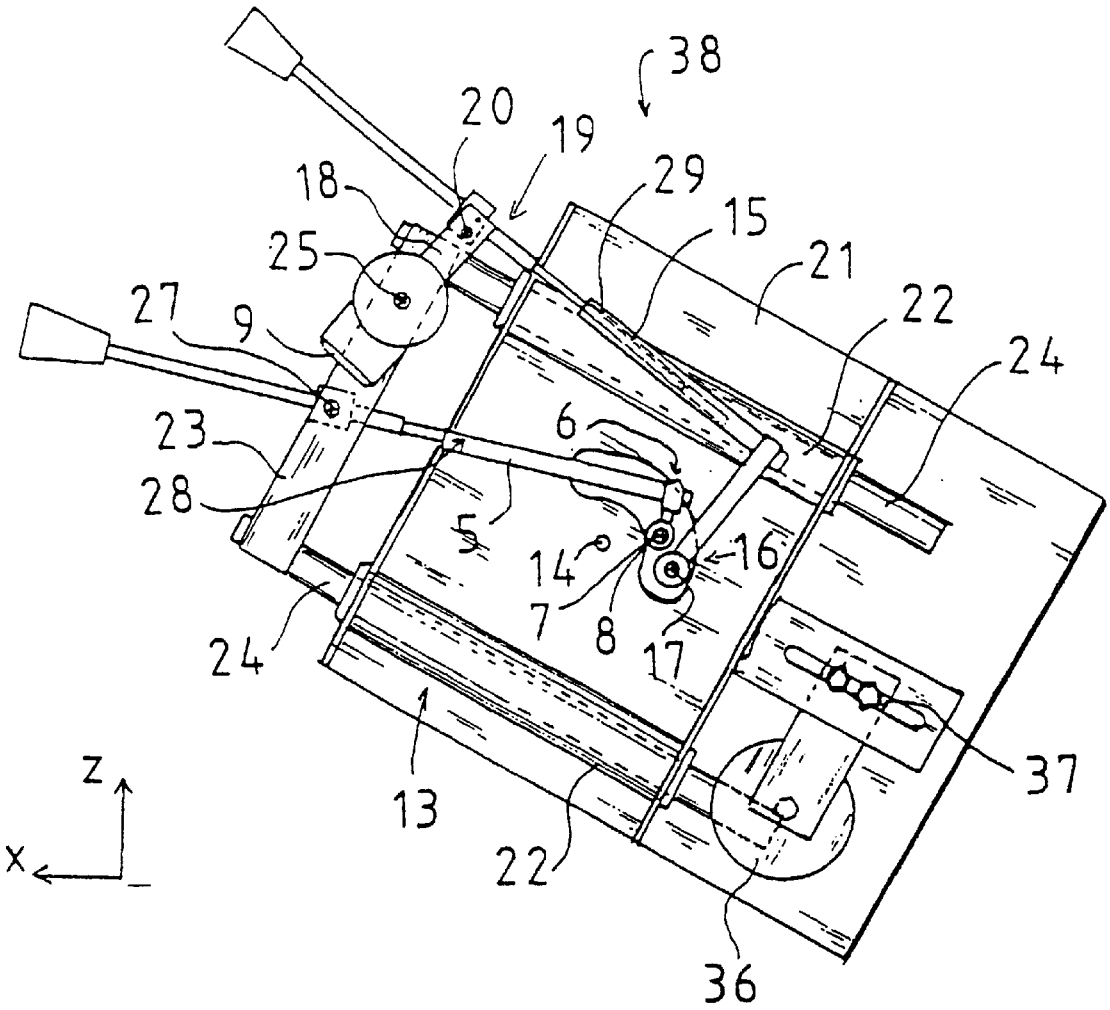
FIG. 3 presents a turning mechanism comprised in the apparatus in FIGS. 1 and 2 for controlling the motion of the head rest along a path with varying radius in a position that corresponds to the extreme flexed position of the neck.
Figure 4:
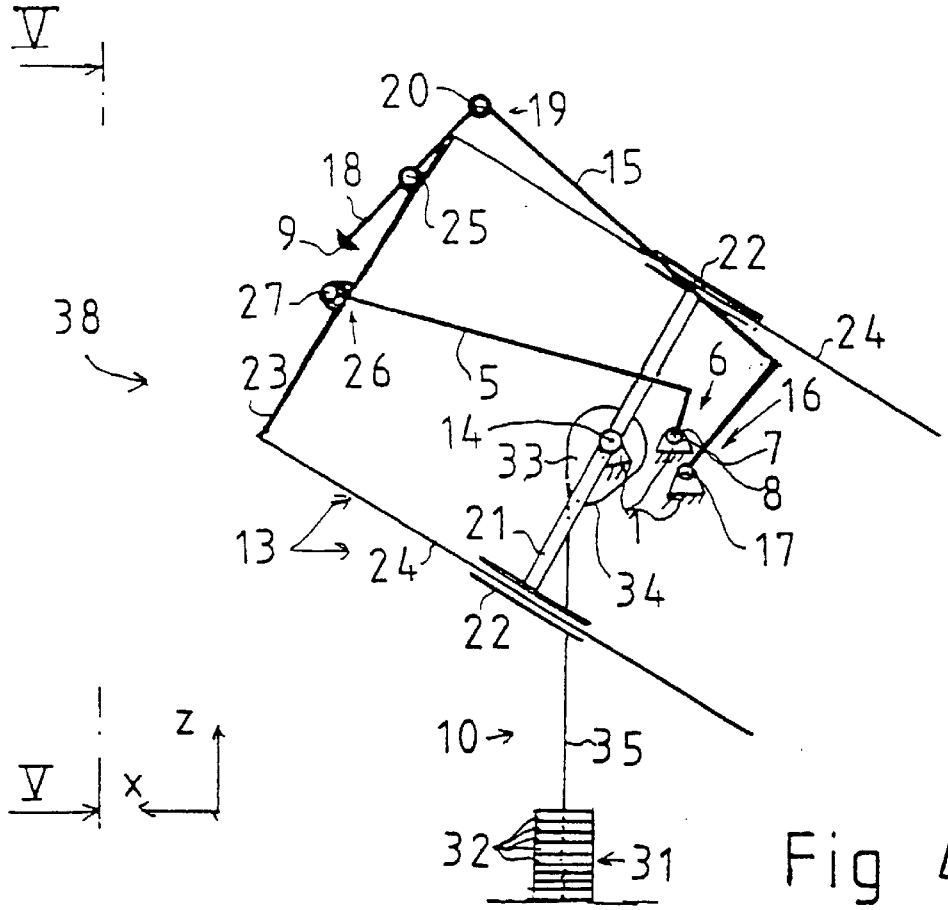
FIG. 4 is a diagram representing the principle of the mechanism in FIG. 3 when in the position shown in FIG. 3.
Figure 5:
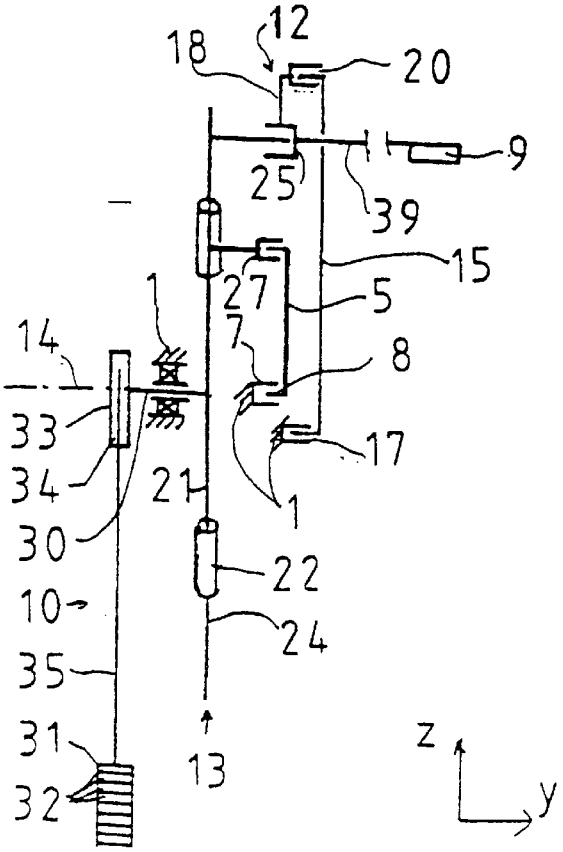
FIG. 5 is a diagram representing the principle of the mechanism in FIG. 3 as seen from the direction V—V in FIG. 4.

The turning mechanism 38 of the head rest 9, which in FIGS. 1 and 2 is protected with a casing, is presented in FIG. 3 in lateral view. FIG. 3 shows the turning mechanism 38 in a position corresponding to the extreme flexion position I. The same mechanism 38 is presented in FIG. 6 in a position corresponding to the extreme extension position II. FIGS. 4 and 5 are simplified skeleton diagrams illustrating the structure of the turning mechanism 38 and the interconnections between the components.

As shown in FIGS. 3–5, the turning mechanism comprises a link rod 5 pivoted by its first end 6 on the equipment frame via a first joint 7 permitting a turning motion in the x-z plane about a swing axis 8 perpendicular to the vertical middle plane of the seat, i.e. parallel to the y direction. The link rod 5 forms a part of the multi-joint angular linkage mechanism. The multi-joint angular linkage mechanism 12 is connected to the head rest 9 to control its motion during exercise so that it will move along a curved path that substantially coincides with the natural, elliptical, variable-radius path of the neck during flexion and extension movements of the neck without producing any relative motion between the head rest 9 and the point of contact between the neck and the head rest 9. Therefore, the point of application of the load applied by the head rest pad 9 to the neck will not change and thus no chafing occurs.

As shown in FIGS. 4 and 5, the multi-joint angular linkage mechanism 12 is functionally a so-called five-joint planar mechanism. Although in practice the joints have to be disposed in different planes, as can be seen from FIG. 5, the mechanism still functions like a planar mechanism because the swing axes about which the actual turning motion occurs are laid in the y direction. This five-joint planar mechanism is controlled by a control gear 13. The control gear 13 rotates about a swing axis 14 immobile relative to the equipment frame 1. The swing axis 14 of the link rod 5 is disposed at a distance from the first joint 7 but in its vicinity.

The mechanism further comprises an auxiliary link rod 15 pivoted by its first end 16 on the equipment frame 1 via a second joint 17 disposed at a close distance from the first joint 7. The head rest 9 is attached via a bar 39 to a head rest support 18, on which the second end 19 of the auxiliary link rod 15 is pivoted via a third joint 20. The control gear 13 comprises a first frame component 21, which is pivoted on the equipment frame 1 so that it can rotate about the swing axis 14. The first frame component 21 comprises two first guides 22 disposed at a distance from the centre 14 of rotation of the first frame component 21 on either side of it. The first guides 22 are elongated sleeves. The second frame component 23 is provided with two second guides 24, which are bars, each of which forms a guide pair with one of the first guides or sleeves, permitting movement of the second frame component 23 in a direction determined by the guides in relation to the first frame component 21. The second frame component 23 is a U-shaped body with two parallel bars forming the two legs of the U-shape, constituting the aforementioned second guides, and a straight beam part extending between the bars. The head rest support 18 is pivoted on this beam part of the second frame component 23 via a fourth joint 25, which is at a distance from the third joint 20. The second end 26 of the link rod 5 is also pivoted on the beam part of the second frame component 23 via a fifth joint 27 disposed at a distance from the third joint 20 and the fourth joint 25. Thus, the five-joint planar mechanism consists of the equipment frame 1, which forms the fixed base of the mechanism, between the first joint 7 and the second joint 17, the auxiliary link rod 15 between the second joint 17 and the third joint 20, the head rest support 18 between the third joint 20 and the fourth joint 25, the second frame component 23 between the fourth joint 25 and the fifth joint 27, and the link rod 5 between the fifth joint 27 and the first joint 7.

As shown in FIG. 3, the link rod 5 comprises second adjusting elements 28 to allow adjustment of the distance between the first joint 7 and the fifth joint 27. Correspondingly, the auxiliary link rod 15 comprises third adjusting elements 29 to allow adjustment of the distance between the second joint 17 and the third joint 20. Both the link rod 5 and the auxiliary link rod 15 are composed of two parts, which comprise a first bar provided with an external thread with a knob at the other end, the external thread of the first bar being fitted in an internal thread provided in a second bar. By turning the first component bar by the knob in relation to the second component bar, the link rod can be shortened or lengthened, depending on the turning direction. Thus, by adjusting the length of the link rods 5 and 15, the path of the head rest 9 and its position relative to the neck can be adjusted to suit each person individually.

As shown in FIGS. 3 and 6, the mechanism comprises a balancing counterweight 36 connected to the first frame component 21 for balancing the structural assembly rotating about the swing axis 14. Moreover, the first frame component 21 comprises fourth adjusting elements 37 for the adjustment of the distance of the balancing counterweight 36 from the swing axis 14. By means of the balancing counterweight 36, the mechanism can be completely balanced so that the apparatus allows a zero stress situation such that substantially no resistance to the motion of the head rest pad 9 appears during the turning movement.

The diagrams in FIGS. 4 and 5 show the resistance means 10 that produces the resistance to the exercise movement. As can be seen especially in FIG. 5, the apparatus comprises a turning arbor 30 rotatably mounted with bearings on the equipment frame 1. The first frame component 21 is fixed to the turning arbor 30. The resistance means 10 is connected to the turning arbor 30 to generate a torque opposing the rotation of the turning arbor 30. The resistance means 10 works on the principle of gravity resistance and it comprises a counterweight 31, which consists of a number of individual weight elements 32 of a given weight. By using an appropriate number of weight elements, a predetermined load can be achieved.

The resistance means 10 comprises an eccentric gear 33 which is connected to the turning arbor 30 and comprises an eccentric surface 34 or the like. A flexible elongated draw element 35, e.g. a wire cable, is connected to the counterweight 31 and, on the other hand, arranged in functional contact with the eccentric surface or the like. Thus, as the draw element 35 is wound around the eccentric surface 34 or the like, a load opposing the exercise movement with a force that varies in a predetermined manner as a function of the rotational angle of the turning arbor 30 is achieved.

The invention is not restricted to the examples of its embodiments described above, but many variations are possible within the scope of the inventive idea defined by the claims.

What is claimed is:

1. An apparatus for exercise and/or rehabilitation of neck extensors by flexion and extension movements, said apparatus comprising:

an equipment frame (1), a seat (2) provided with a back rest (3), and holding means (4) for holding a person's body substantially immobile in position relative to the back rest;

a link rod (5) pivoted by its first end (6) on the equipment frame via a first joint (7) permitting a turning motion about a swing axis (8) perpendicular to a vertical middle plane of the seat;

a head rest (9) functionally connected to the link rod (5) so that the link rod participates in turning the head rest during an exercise movement while the person's head is leaning against the head rest;

a resistance means (10) for generating a force opposing the exercise movement;

adjusting elements (11) for adjustment of a position of the seat in relation to the equipment frame (1);

the head rest (9) being substantially fitted to receive an upper part of the person's neck; and a multi-joint angular linkage mechanism (12), of which the link rod (5) constitutes a part, said multi-joint angular linkage mechanism (12) being connected to the head rest (9) so as to cause it to move during an exercise movement along a curved path that substantially coincides with a natural path of the person's neck during flexion and extension movements of the person's neck without producing any relative motion between the head rest (9) and a point of contact between the person's neck and the head rest (9).

2. The apparatus as defined in claim 1, wherein movement of the head rest (9) follows a path of varying radius.

3. An apparatus for exercise and/or rehabilitation of neck extensors by flexion and extension movements, said apparatus comprising:

an equipment frame (1), a seat (2) provided with a back rest (3), and holding means (4) for holding a person's body substantially immobile in position relative to the back rest;

a link rod (5) pivoted by its first end (6) on the equipment frame via a first joint (7) permitting a turning motion about a swing axis (8) perpendicular to a vertical middle plane of the seat;

a head rest (9) functionally connected to the link rod (5) so that the link rod participates in turning the head rest during an exercise movement while the person's head in leaning against the head rest;

a resistance means (10) for generating a force opposing the exercise movement;

adjusting elements (11) for adjustment of a position of the seat in relation to the equipment frame (1);

the head rest (9) being substantially fitted to receive an upper part of the person's neck; and a multi-joint angular linkage mechanism (12), of which the link rod (5) constitutes a part, said multi-joint angular linkage mechanism (12) being connected to the head rest (9) so as to cause it to move during an exercise movement along a curved path that substantially coincides with a natural path of the person's neck during flexion and extension movements of the person's neck without producing any relative motion between the head rest (9) and a point of contact between the person's neck and the head rest (9)

wherein the multi-joint angular linkage mechanism (12) is functionally a five-joint planar mechanism, wherein the apparatus further comprises a control gear (13) for controlling motion of the multi-joint angular linkage mechanism, wherein the control gear (13) is rotatable about a swing axis (14) immovable with respect to the equipment frame (1), and wherein the swing axis (14) is disposed at a distance from the first joint (7) but in its vicinity.

4. The apparatus as defined in claim 3, wherein the apparatus further comprises an auxiliary link rod (15), whose first end is pivotally mounted on the equipment frame (1) via a second joint (17) disposed at a distance from the first joint (7) but in its vicinity; and a head rest support (18) to the which the head rest (9) is attached, a second end (19) of the auxiliary link rod (15) being pivoted on said head rest support via a third joint (20);

wherein the control gear (13) comprises a first frame component (21), which is rotatably mounted on the equipment frame (1) and provided with a first guide (22) disposed at a distance from a center of rotation of the first frame component (21), and a second frame component (23), which is provided with a second guide (24), forming a guide pair with the first guide, permitting movement of the second frame component in a direction determined by the first and second guides in relation to the first frame component;

wherein the head rest support (18) is pivoted on the second frame component (23) via a fourth joint (25) disposed at a distance from the third joint (20);

wherein a second end (26) of the link rod (5) is pivoted on the second frame component (23) via a fifth joint (27) disposed at a distance from the third joint and the fourth joint.

5. The apparatus as defined in claim 4, wherein the link rod (5) comprises second adjusting elements (28) to allow adjustment of a distance between the first joint (7) and the fifth joint (27).

6. The apparatus as defined in claim 4, wherein the auxiliary link rod (15) comprises third adjusting elements (29) to allow adjustment of a distance between the second joint (27) and the third joint (20).

7. The apparatus as defined in claim 1, wherein the resistance means (10) opposes a turning motion of the link rod (5).

8. The apparatus as defined in claim 4, further comprising a turning arbor (30) rotatably mounted with bearings on the equipment frame (1), and wherein the first frame component (21) is attached to the turning arbor (30) and the resistance means (10) is connected to the turning arbor (30) to generate a torque opposing the rotation of the turning arbor.

9. The apparatus as defined in claim 8, wherein the resistance means (10) comprises a counterweight (31) with plural individual weight elements (32), which can be combined so as to create a predetermined load.

10. The apparatus as defined in claim 8, wherein the resistance means (10) comprises an eccentric gear (33) connected to the turning arbor (30) and an eccentric surface (34), a flexible elongated draw element (35) connected to the counterweight (31) and, a load opposing the exercise movement with a force that varies in a predetermined manner as a function of the rotational angle of the turning arbor.

11. The apparatus as defined in claim 4, wherein the first frame component (21) comprises a balancing counterweight (36) for balancing the structural assembly rotating about the swing axis (14).

12. The apparatus as defined in claim 11, wherein the first frame component (21) comprises fourth adjusting elements (37) to allow adjustment of the distance of the balancing counterweight (36) from the swing axis (14).

13. A neck exercise/rehabilitation apparatus comprising:

a frame;

a head rest movably connected to said frame and arranged and adapted to contact a neck of a person to receive neck exercise/rehabilitation;

a control device that rotates about an axis that is fixed relative to said frame, said control device having an arcuate slot therein that is spaced from said axis; and a control arm pivotally linked to said movable head rest and to a joint that moves in said arcuate slot, said control arm moving said movable head rest in a path with a varying radius during rotation of said control device.

14. The apparatus of claim 13, further comprising a component to which said movable head rest is pivotally attached and a guide in which said component moves generally radially relative to said axis during rotation of said control device.

15. The apparatus of claim 13, further comprising a second control arm pivotally linked to said movable head rest and to a second joint that moves in said arcuate slot, said second control arm pivoting said movable head rest during rotation of said control device.

* * * * *

UNITED STATES PATENT AND TRADEMARK OFFICE

CERTIFICATE OF CORRECTION

PATENT NO. : 6,454,680 B1
APPLICATION NO. : 09/582718
DATED : September 24, 2002
INVENTOR(S) : Simo Taimela It is certified that error appears in the above-identified patent and that said Letters Patent is hereby corrected as shown below:

On the title page, between Items (87) and (51) insert Item (30) as follows:

--(30) Foreign Application Priority Data

Dec. 30, 1997 (FI).....974645--.

Signed and Sealed this

Eighteenth Day of July, 2006

JON W. DUDAS
*Director of the United States Patent and Trademark Office*